US006070855A

United States Patent [19]

Chuang et al.

[11] Patent Number: 6,070,855

[45] Date of Patent: Jun. 6, 2000

[54] MINOR-AMOUNT RELEASE VALVE FOR A HAND AIR PUMP

[76] Inventors: Louis Chuang; Scott Wu, both of P.O. Box 63-247, Taichung, Taiwan

[21] Appl. No.: 09/247,677

[22] Filed: Feb. 9, 1999

[30] Foreign Application Priority Data

Apr. 29, 1998 [TW] Taiwan ..... 87206581

[51] Int. Cl.[7] ..... F16K 1/44; F16K 15/20

[52] U.S. Cl. ..... 251/322; 251/339; 251/900

[58] Field of Search ..... 137/228; 251/322, 251/321, 339, 900

[56] References Cited

U.S. PATENT DOCUMENTS

| | | | |
|---|---|---|---|
| 904,329 | 11/1908 | Hohman | 251/321 X |
| 2,577,654 | 12/1951 | Gates | 251/322 |
| 3,008,686 | 11/1961 | Becker | 251/339 X |
| 3,239,192 | 3/1966 | Totten | 251/322 |
| 5,054,514 | 10/1991 | Marin | 137/454.2 |
| 5,390,899 | 2/1995 | Perez | 251/339 |
| 5,665,908 | 9/1997 | Burkey et al. | 73/146.8 |

*Primary Examiner*—John Rivell
*Assistant Examiner*—Meredith H. Schoenfeld
*Attorney, Agent, or Firm*—Alan Kamrath; Oppenheimer Wolff & Donnelly LLC

[57] ABSTRACT

A minor-amount release valve includes a valve seat having a first end mounted in a receptacle communicated with an air chamber. The valve seat includes a through hole for communicating the receptacle with atmosphere. The first end of the valve seat includes an end face having a recessed section around the through hole. A stem is slidably extended through the through hole of the valve seat in a manner that an air passage is defined between the receptacle and atmosphere. The stem includes a first end located in the receptacle and a second end for manual operation. The first end of the stem includes a flange formed thereon, the stem further including a transverse hole that communicates with the air passage. A seal ring is positioned in the recessed section of the first end of the valve seat and has a width smaller than a diameter of the transverse hole. The seal ring blocks the air passage when the transverse hole of the stem is not aligned with the seal ring, and air in the air chamber is released to atmosphere when the transverse hole is aligned with the seal ring. An elastic member is attached between the flange and an end wall that defines a portion of the receptacle. The elastic member biases the stem to a sealing position in which the transverse hole of the stem is not aligned with the seal ring.

5 Claims, 7 Drawing Sheets

MINOR-AMOUNT RELEASE VALVE FOR A HAND AIR PUMP

BACKGROUND OF THE INVENTION

1. Field of the Invention

The present invention relates to a minor-amount release valve for a hand air pump in which air pressure in a cushion device communicated with the hand air pump can be released by a minor amount to adjust the shock-absorbing ability of the cushion device mounted to a bicycle.

2. Description of the Related Art

Some bicycles are equipped with cushion devices in the front forks thereof to absorb shocks during cycling. The cushion devices include springs or air that performs the shock-absorbing function. FIG. 1 of the drawings illustrates a typical pneumatic cushion device that includes a valve 11 and an upper lid 10. Air is pumped into the cushion device by, e.g., a hand air pump via the valve 11. Some hand air pumps are equipped with a release valve to allow release of air inside the cushion device to adjust air pressure. Thus, the shock-absorbing ability of the cushion device can be adjusted. FIG. 2 of the drawings illustrates a release valve for a hand air pump 12. The hand air pump 12 includes a receptacle 16 that communicates with an air chamber (not shown) of a cushion device (not shown) mounted in a bicycle front fork (not shown). The release valve includes a valve seat 13 partially mounted in the receptacle 16 and having a hole 131 communicated the receptacle 16 with atmosphere, and a stem 132 extended through the hole 131. A clearance 135 is defined between the stem 132 and an inner periphery that defines the hole 131 and thus forms an air passage 135. An end of the stem 132 locates in the receptacle 16 and has a flange 134 formed thereon. A seal ring 14 is mounted around the stem 132 and secured to a side of the flange 134. A spring 15 is attached between the flange 134 and an end wall that defines a portion of the receptacle 16 for biasing the stem 132 away from the receptacle 16 such that the seal ring 14 is moved to block the air passage 135. When air pressure in the cushion device is found too high, the user may press a push button 133 attached to the other end of the stem 132 to overcome the spring force and thus unblock the passage 135. Thus, air in the cushion device is released via the receptacle 16 and the air passage 135. It is, however, found that the amount of air released is relatively large in a short time such that the user has to refill air into the cushion device, as the air pressure in the cushion device is relatively high. Control of the air amount to be released by the push button is difficult as the air pressure is high and the spring force is large. The present invention is intended to provide an improved release valve for a hand air pump that mitigates and/or obviates the above problems.

SUMMARY OF THE INVENTION

It is a primary object of the present invention to provide an improved release valve for a hand air pump that may release air by a relatively small amount.

A minor-amount release valve in accordance with the present invention comprises:

a valve seat including a first end adapted to be mounted in a receptacle communicated with an air chamber and a second end, the valve seat including a through hole for communicating the receptacle with atmosphere, the first end of the valve seat including an end face having a recessed section around the through hole, a stem slidably extended through the through hole of the valve seat in a manner that an air passage is defined between the receptacle and atmosphere, the stem including a first end located in the receptacle and a second end for manual operation, the first end of the stem including a flange formed thereon, the stem further including a transverse hole that communicates with the air passage, a seal ring positioned in the recessed section of the first end of the valve seat and having a width smaller than a diameter of the transverse hole, the seal ring blocking the air passage when the transverse hole of the stem is not aligned with the seal ring, and air in the air chamber is released to atmosphere when the transverse hole is aligned with the seal ring, and an elastic member attached between the flange and an end wall that defines a portion of the receptacle, the elastic member biasing the stem to a sealing position in which the transverse hole of the stem is not aligned with the seal ring.

A push button is attached to the second end of the stem for manual operation. The second end of the valve seat includes a groove for slidably receiving the push button.

The stem slidably extends through the through hole of the valve seat in a manner that a clearance exists between the stem and an inner periphery that defines the through hole to thereby define the air passage.

The end face of the first end of the valve seat includes a stop formed thereon for retaining the seal ring in place.

In an alternative embodiment of the invention, the transverse hole in the stem is replaced by an annular groove that has a width greater than that of the seal ring to provide a function identical to the transverse hole.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
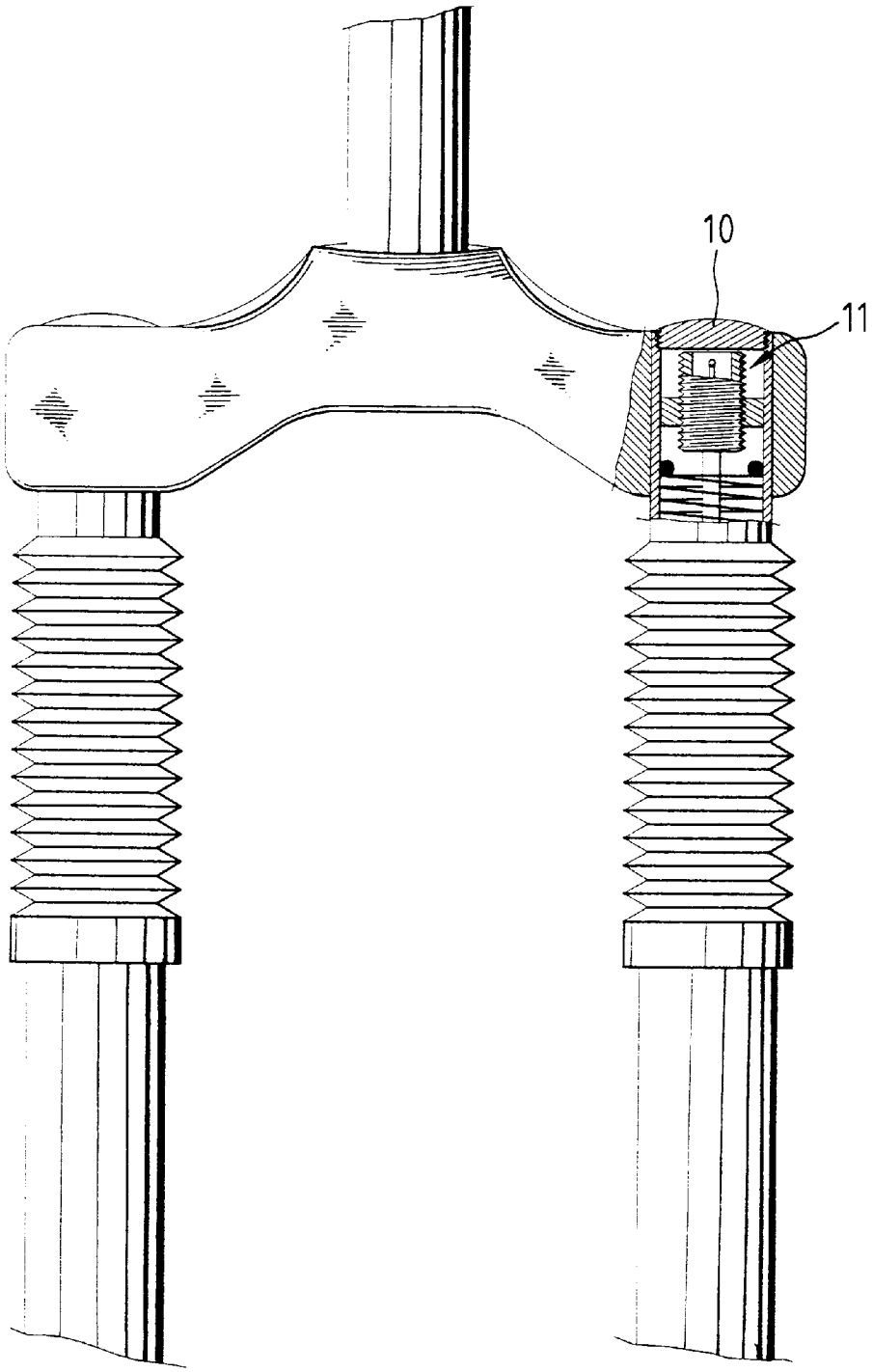
Fig. 1 PRIOR ART
FIG. 1 is a partial front view, partially sectioned, of a bicycle front fork with a pneumatic cushion device.
Figure 2:
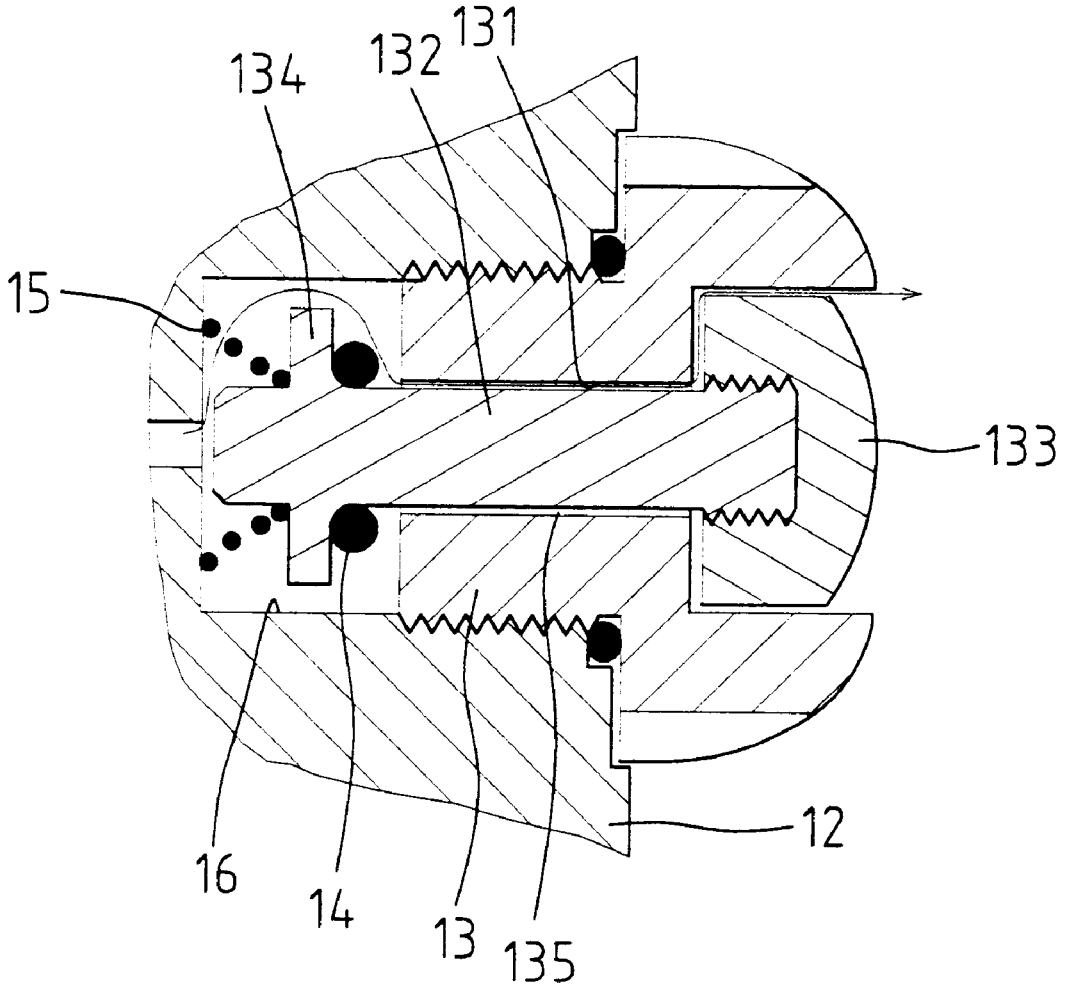
Fig. 2 PRIOR ART
FIG. 2 is a partial sectional view illustrating a conventional release valve for a hand air pump.
Figure 3:
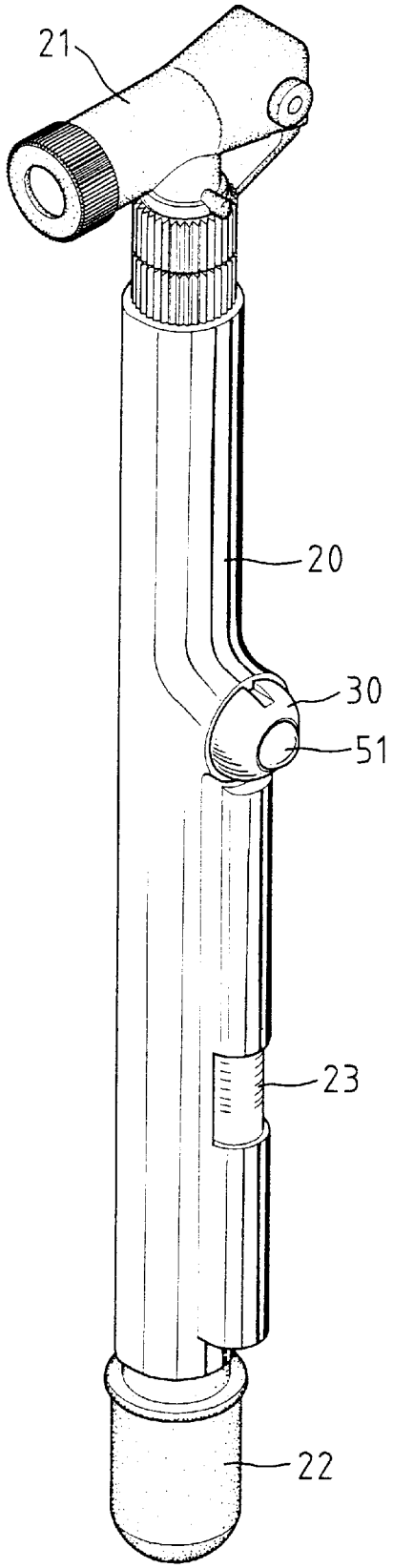
FIG. 3 is a perspective view of a hand air pump with a minor-amount release valve in accordance with the present invention.
Figure 4:
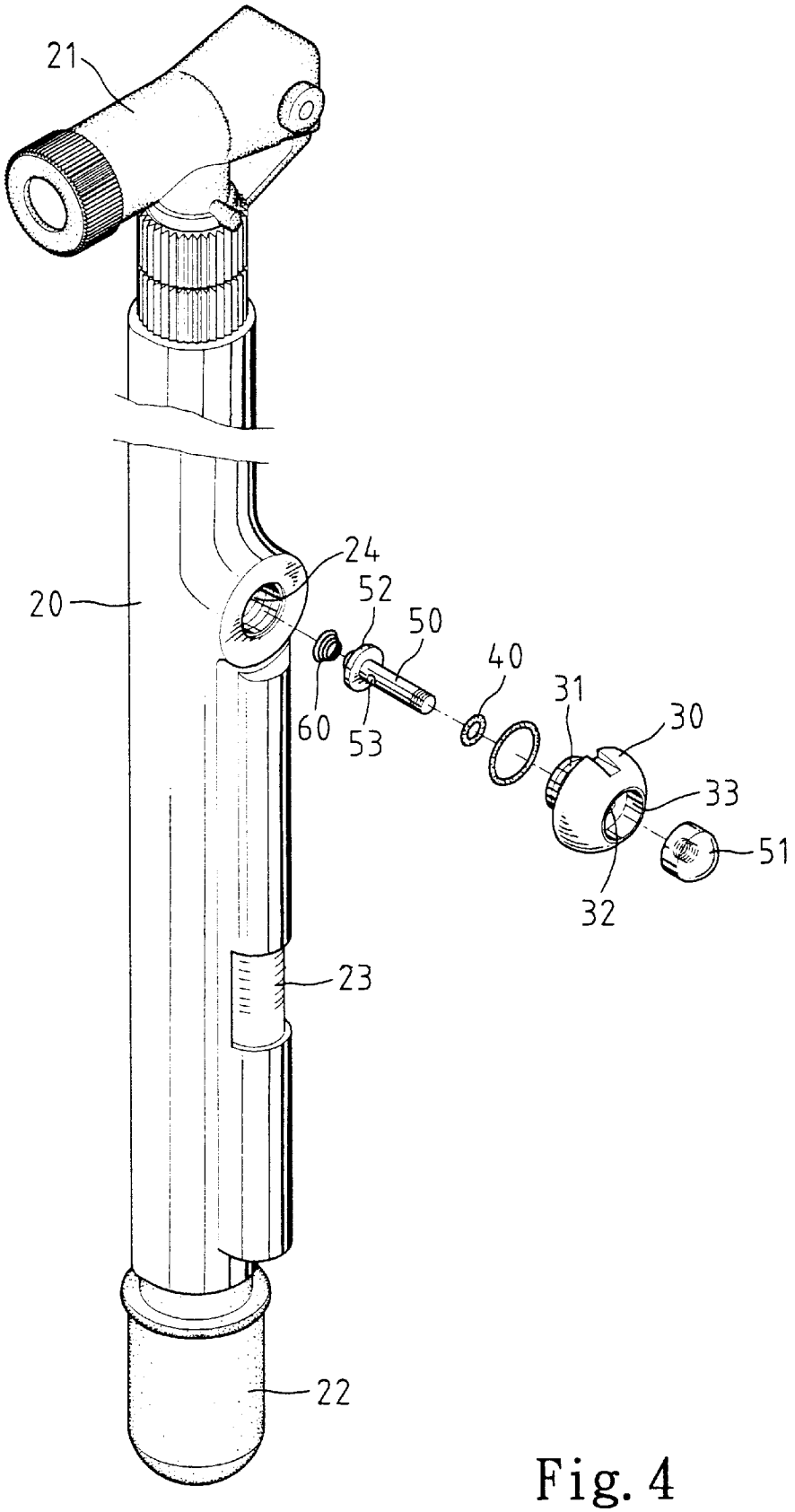
FIG. 4 is a perspective view, partially exploded, of the hand air pump in FIG. 3.

Referring to FIGS. 3 and 4, a hand air pump 20 generally includes a pumping device 21 for pumping air into, e.g., a cushion device (not shown) of a bicycle front fork by means of reciprocating operation of an operative handle 22, which is conventional and therefore not described in detail. A pressure gauge 23 is mounted to the hand air pump 20 to indicate air pressure in the cushion device. A release valve 30 in accordance with the present invention is mounted to a main body 25 of the hand air pump 20 to allow minor-amount release of air.

Figure 5:
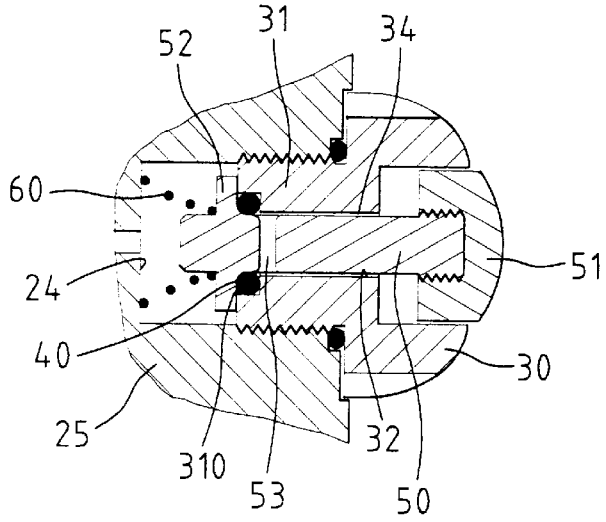
FIG. 5 is a partial sectional view illustrating the minor-amount release valve in accordance with the present invention.

Referring to FIGS. 4 and 5, the release valve 30 includes a valve seat 33 that has a first end received in a receptacle 24 of the main body 25 that communicates with the cushion device via an air chamber (not shown) of the main body 25 of the hand air pump 20. In this embodiment, the first end 31 of the valve seat 33 is secured in the receptacle 24 by threading engagement. The first end 31 of the release valve 30 further includes a through hole 32 that communicates the receptacle 24 with atmosphere. The release valve 30 further includes a second end outside the main body 25 of the hand air pump 20 and having a groove (not labeled). A stem 50 is slidably extended through the through hole 32 and includes a first end located in the receptacle 24 and a second end located in the groove in the second end of the release valve 30. A push button 51 is attached to the second end of the stem 50 for manual operation, which will be described later.

The first end 31 of the valve seat 33 includes an end face with a recessed section 310 around the through hole 32. The stem 50 is partially received in the through hole 32 in a manner that a clearance 34 exists between the stem 50 and an inner periphery that defines the through hole 32 to thereby define an air passage 34 through which air is passable between the receptacle 24 and atmosphere. A seal ring 40 is positioned in the recessed section 310 to block the air passage 34. A flange 52 is formed on the first end of the stem 50 and located in the receptacle 24. An elastic member 60 is attached between the flange 52 and an end wall (not labeled) that defines a portion of the receptacle 24. The stem 50 includes a transverse hole 53 defined in an outer periphery thereof and located between the flange 52 and the push button 51. The transverse hole 53 has a diameter greater than a width of the seal ring 40.

Figure 6:
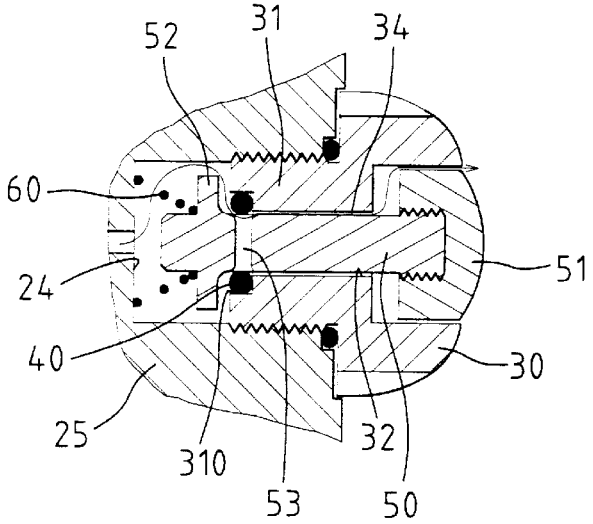
FIG. 6 is a view similar to FIG. 5, wherein a push button is pressed for releasing air.
Figure 7:
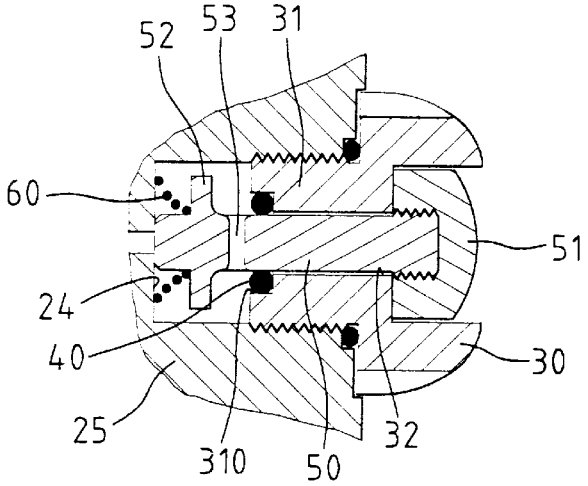
FIG. 7 is a view similar to FIG. 5, wherein the push button is pressed to move beyond a critical point for releasing air.

As can be seen from FIG. 5, the stem 50 is normally biased by the elastic member 60 to a sealing position, in which the transverse hole 53 is not aligned with the seal ring 40. After pumping, the user may read the air pressure in the cushion device via the pressure gauge 23. If the air pressure is found too high, the user may press the push button 51 to move the stem inwardly. Referring to FIG. 6, when the transvese hole 53 is aligned with the seal ring 40 positioned in the recessed section 310 of the valve seat 33, air inside the cushion device is released to atmosphere by a minor amount via the receptacle 24 and the air passage 34, as the diameter of the transverse hole 53 is greater than the width of the seal ring 40. Referring to FIG. 7, when the stem 50 moves further inwardly such that the transverse hole 53 does not align with the seal ring 40, the air passage 34 is blocked again by the seal ring 40. When the push button 51 is released, the stem 50 moves outwardly to its initial position shown in FIG. 5 under the action of the elastic member 60. The air in the cushion device is released again by a minor amount when the transverse hole 53 of the stem 50 is aligned with the seal ring 40 again. Thus, by means of repeatedly pressing and releasing the push button 51, the release valve in accordance with the present invention can be used to release air by minor-amount until the air reaches the required pressure.

Figure 11:
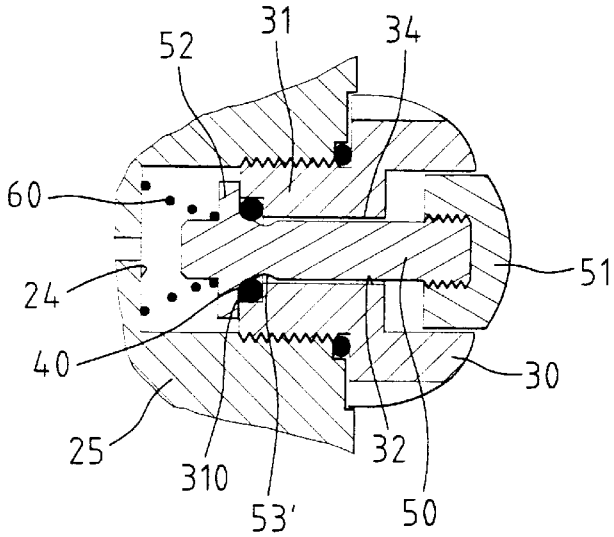
FIG. 11 is a partial sectional view of another modified embodiment of the minor-amount release valve in accordance with the present invention, wherein the transverse groove in FIG. 8 is replaced by an annular groove.
Figure 12:
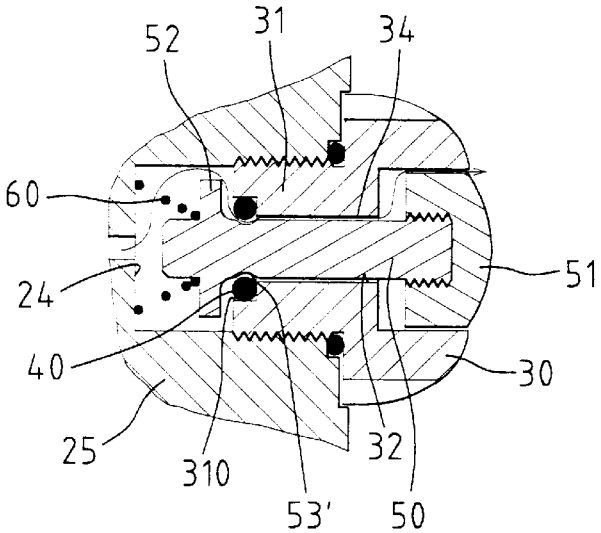
FIG. 12 is a view similar to FIG. 11, wherein a push button is pressed for releasing air.
Figure 13:
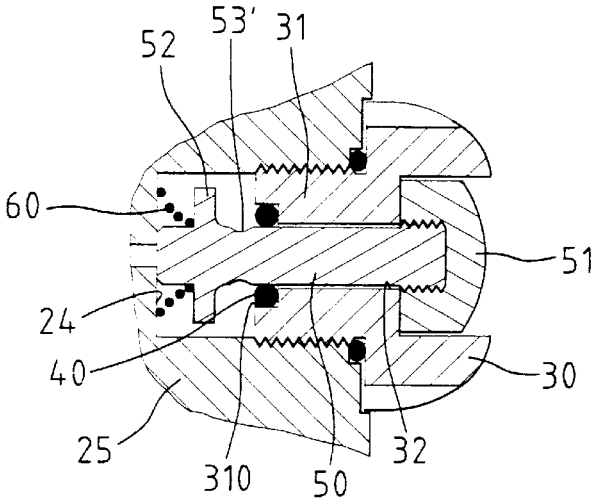
FIG. 13 is a view similar to FIG. 11, wherein the push button is pressed to move beyond a critical point for releasing air.

FIG. 11 illustrates a modified embodiment of the release valve, wherein the transverse hole 53 is replaced by an annular groove 53' that has a width greater than the width of the seal ring 40 to allow air to be released via the receptacle 24, the annular groove 53', and the air passage 34 when the annular groove 53' is aligned with the seal ring 40 during travel of the stem 50 upon pressing of the push button 51, as shown in FIG. 12. When the annular groove 53' is not aligned with the seal ring 40, the seal ring 40 blocks the air passage 34, as shown in FIGS. 11 and 13.

Figure 8:
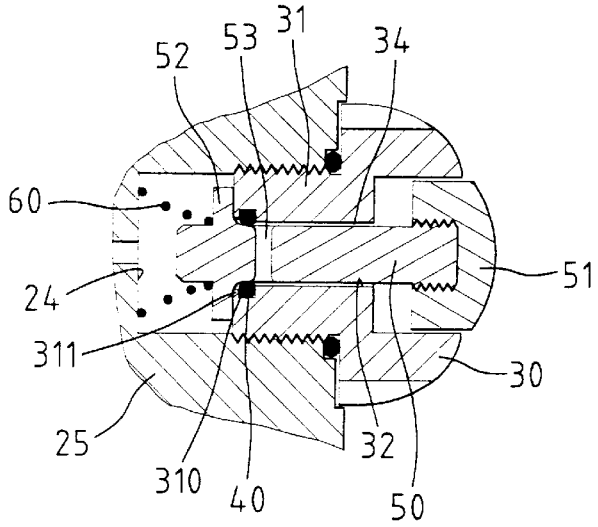
FIG. 8 is a partial sectional view of a modified embodiment of the minor-amount release valve in accordance with the present invention.
Figure 9:
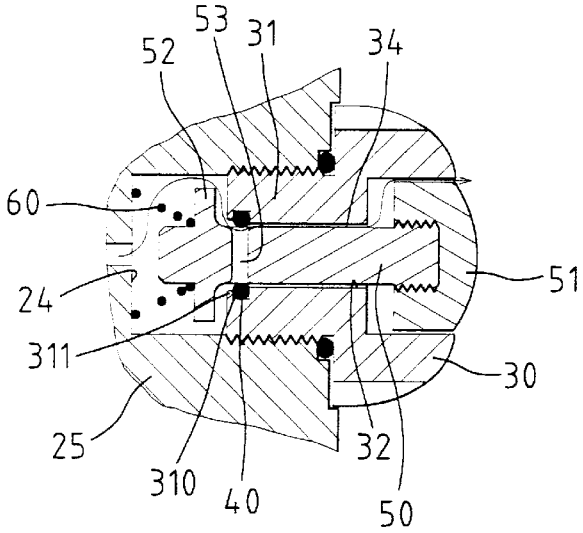
FIG. 9 is a view similar to FIG. 8, wherein a push button is pressed for releasing air.
Figure 10:
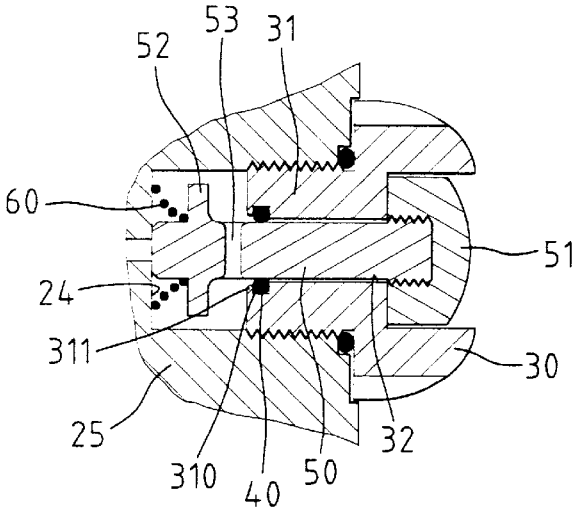
FIG. 10 is a view similar to FIG. 8, wherein the push button is pressed to move beyond a critical point for releasing air.

FIG. 8 illustrates another modified embodiment of the release valve in accordance with the present invention, wherein the seal ring 40 is held in place by a stop 311 formed on the end face of the first end 31 of the valve seat 30 in which the recessed section 310 is defined.

It is appreciated that the release valve in accordance with the present invention is simple in structure as no complicated air passages are involved. The manufacture cost is low, the maintenance is easy, and the operation is simple.

Although the minor-amount release valve in accordance with the present invention is illustrated with reference to a hand air pump for releasing air pressure in a cushion device for a bicycle front fork, it is appreciated that the release valve in accordance with the present invention can be used in other conditions where release of minor amount of air is required.

Although the invention has been explained in relation to its preferred embodiment, it is to be understood that many other possible modifications and variations can be made without departing from the spirit and scope of the invention as hereinafter claimed.

What is claimed is:

1. A minor-amount release valve comprising:

a valve seat including a first end adapted to be mounted in a receptacle communicated with an air chamber and a second end, the valve seat including a through hole for communicating the receptacle with atmosphere, the first end of the valve seat including an end face having a recessed section around the through hole, a stem slidably extended through the through hole of the valve seat in a manner that an air passage is defined between the receptacle and atmosphere, the stem including a first end located in the receptacle and a second end for manual operation, the first end of the stem including a flange formed thereon, the stem further including a transverse hole that communicates with the air passage, a seal ring positioned in the recessed section of the first end of the valve seat and having a width smaller than a diameter of the transverse hole, the seal ring blocking the air passage when the transverse hole of the stem is not aligned with the seal ring, and air in the air chamber is released to atmosphere when the transverse hole is aligned with the seal ring, and an elastic member attached between the flange and an end wall that defines a portion of the receptacle, the elastic member biasing the stem to a sealing position in which the transverse hole of the stem is not aligned with the seal ring.

2. The minor-amount release valve as claimed in claim 1, further comprising a push button attached to the second end of the stem for manual operation.

3. The minor-amount release valve as claimed in claim 2, wherein the second end of the valve seat includes a groove for slidably receiving the push button.

4. The minor-amount release valve as claimed in claim 1, wherein the stem slidably extends through the through hole of the valve seat in a manner that a clearance exists between the stem and an inner periphery that defines the through hole to thereby define the air passage.

5. The minor-amount release valve as claimed in claim 1, wherein the end face of the first end of the valve seat includes a stop formed thereon for retaining the seal ring in place.

* * * * *